US005450729A

United States Patent [19]

Hilton

[11] Patent Number: 5,450,729

[45] Date of Patent: Sep. 19, 1995

[54] CRYOPUMP

[75] Inventor: David J. Hilton, Palmer Lake, Colo.

[73] Assignee: Extek Cryogenics Inc., Colorado Springs, Colo.

[21] Appl. No.: 184,495

[22] Filed: Jan. 18, 1994

Related U.S. Application Data

[63] Continuation of Ser. No. 903,779, Jun. 24, 1992, abandoned.

[51] Int. Cl.[6] ..... B01D 8/00

[52] U.S. Cl. ..... 62/55.5; 417/901; 502/402; 502/527

[58] Field of Search ..... 62/55.5; 502/527, 400, 502/401, 402; 417/901

[56] References Cited

U.S. PATENT DOCUMENTS

| | | | |
|---|---|---|---|
| 3,309,844 | 3/1967 | Hemstreet et al. | 62/55.5 |
| 3,387,767 | 6/1968 | Hecht | 62/55.5 |
| 4,089,185 | 5/1978 | Kemmer et al. | 62/55.5 |
| 4,121,430 | 10/1978 | Bachler et al. | 62/55.5 |
| 4,198,829 | 4/1980 | Carle | 62/55.5 |
| 4,240,262 | 12/1980 | Nakamura et al. | 62/55.5 |
| 4,277,951 | 7/1981 | Longsworth | 62/55.5 |
| 4,285,710 | 8/1981 | Welch | 62/40 |
| 4,295,338 | 10/1981 | Welch | 62/55.5 |
| 4,311,018 | 1/1982 | Welch | 62/55.5 |
| 4,325,220 | 4/1982 | McFarlin | 62/55.5 |
| 4,336,690 | 6/1982 | Welch | 62/55.5 |
| 4,356,701 | 11/1982 | Bartlett et al. | 62/55.5 |
| 4,438,632 | 3/1984 | Lessard et al. | 62/55.5 |
| 4,446,702 | 5/1984 | Peterson et al. | 62/55.5 |
| 4,530,213 | 7/1985 | Kadi | 62/55.5 |
| 4,580,404 | 4/1986 | Pez et al. | 62/55.5 |
| 5,000,007 | 3/1991 | Haefner | 62/55.5 |

*Primary Examiner*—Ronald C. Capossela
*Attorney, Agent, or Firm*—Flehr, Hohbach, Test, Albritton & Herbert

[57] ABSTRACT

A cryopump array is described. Each vane of the array is coated with a 3-dimensional adsorbing structure made up of an adhesive which is transparent to passage of gases to be pumped by adsorption and a plurality of pieces of an appropriate adsorbing material adhered on top of one another.

18 Claims, 3 Drawing Sheets

CRYOPUMP

This is a continuation of application Ser. No. 07/903,779 filed Jun. 24, 1992, now abandoned.

BACKGROUND OF THE INVENTION

The present invention relates to cryogenic vacuum pumping and, more particularly, to an apparatus and method for increasing the adsorbency of adsorbent pumping surfaces. It specifically relates to two-stage cryogenic pumping and an adsorbent panel for such a pump.

In high and ultra-high vacuum pumping, it is common to provide one or more adsorbent surfaces to "pump" certain gases via adsorption. Adsorption is a process by which a surface of a material retains via physical or chemical action, another material which is brought into contact with it. (Adsorption is to be contrasted with absorption in which one material takes another material into the interior of the same. It should be noted that it is adsorption, rather than absorption, when the surface of pores of a porous material retains another material.)

Two-stage cryogenic pumps are used to pump via condensation those gases which condense at a low temperature, and to pump via both adsorption and condensation those gases which pump at an even lower temperature. These pumps typically include one or more condensing surfaces at an initial or first stage for pumping gases, such as water vapor and carbon dioxide, which will condense at the higher temperature, and panels covered with an adsorbing material, such as activated charcoal or artificial zeolite at a second stage to pump those gases, e.g., oxygen, nitrogen, argon, helium, hydrogen and neon, which will be condensed or adsorbed at a lower temperature. These gases are often referred to in the art as "non-condensible" gases. The first stage temperature typically is in the range of 50°–80° K., whereas the second stage is typically in the temperature range of 10°–22° K.

The adsorbent surfaces generally are a single layer of an adsorbent material adhered with a suitable adhesive, such as epoxy, to a panel or other substrate surface. The panel is maintained at the lower temperature and acts to cool the adsorbent material layer as well as condense those gases which do not condense in the first stage of the pump but will condense at its lower temperature.

The capacity of most adsorbent materials is quite limited. In general, a molecule or atom of a gas to be pumped must contact a surface of the adsorbent material before it will be pumped. Once a particular portion of the surface of an adsorbent material has pumped an adsorbent gas, such surface is no longer available to pump additional atoms or molecules of the gas. For this reason, the adsorbent material typically is provided as a multitude of small pieces having microscopic pores to increase the available surface area. These pieces are adhered as a single layer coating on a substrate with an adhesive. The adhesives used in the past for this purpose, e.g. epoxy, can cover and shield or, in other words, passivate a portion of the available surface area of the adsorbent material. One approach considered in the past to increase the capacity of cryogenic pumps is the concept simply of increasing the area within the pump which is coated with the single layer of adsorbent material. The problem with this is that it increases the refrigeration load on the pump. The surface area made available for adsorbency has been optimized in the past with this in mind.

While providing the adsorbent material over an optimum area as a plurality of pieces having microscopic pores is the standard way of dealing with the capacity problem, the pumps available at the time of this invention often require regeneration. In other words, as the surface of the adsorbent material gets "used", the capacity of the pump decreases to such an extent that the adsorbent process is discontinued by the pump operator and the pump is regenerated. That is, the operator terminates communication between the pump and the volume being pumped, and brings the pump to a higher temperature at which the adsorbent material surfaces will release the pumped gases. Such gases are then removed from the interior of the pump by standard techniques. The capacity of two-stage cryopumps available before the instant invention is in the order of 15–20 liters. That is, after pumping this volume of gas, the pumps must be regenerated.

SUMMARY OF THE INVENTION

The present invention significantly increases adsorbent pumping capacity. This capacity is enhanced without the necessity of increasing the area within the pump which is coated with an adsorbent material. From the broad standpoint the invention includes the 3-dimensional adsorbent structure resulting from the combination of an adhesive which is transparent to passage of the gases to be pumped by adsorption and a plurality of pieces of the adsorbent material adhered to a substrate on top of one another by such adhesive. The use of the transparent adhesive enables the pieces of adsorbent material to pump in spite of the presence of such adhesive. That is, while in the past the traditional adhesives have resulted in passivation of the surface areas of the adsorbent material covered by the adhesive, the use of the transparent adhesive prevents the same from affecting the adsorbency of such surface areas. Besides increasing capacity, since the invention does not rely on increasing the lateral size of the panels or other coated surfaces, it is easily retrofittable into most existing pumps.

As another major feature of the instant invention, the 3-dimensional adsorbing structure is provided with a sufficient thickness to form a natural temperature gradient in the direction of projected gas flow therethrough. That is, the coating on the panel is sufficiently thick to provide a temperature gradient from the panel to the exposed coating surface. This natural temperature gradient increases the capacity of the pump. That is, prior arrangements have suffered from molecular mobility loss of the gases to be adsorbed. This mobility loss is due to the temperature of the adsorbent material being sufficiently low to decrease the movement of the gases, causing a loss of diffusion of the same within the adsorbent. It will be recognized if the gases do not diffuse efficiently in the adsorbent, the capacity of the adsorbent material is underutilized. The temperature gradient provided by the 3-dimensional adsorbent structure causes the gases which are not adsorbed on the surface, to be adsorbed as the gases diffuse through the material. In this connection, those gas molecules which are not adsorbed on the surface because of their mobility will suffer a mobility loss as they travel in the 3-dimensional adsorbent structure and thereafter be adsorbed when meeting an adsorbent surface.

Other features and advantages of the invention either will become apparent or will be described in connection with the following, more detailed description of a preferred embodiment of the invention.

BRIEF DESCRIPTION OF THE DRAWING

With reference to the accompanying drawing.

DETAILED DESCRIPTION OF THE PREFERRED EMBODIMENT(S)

Figure 1:
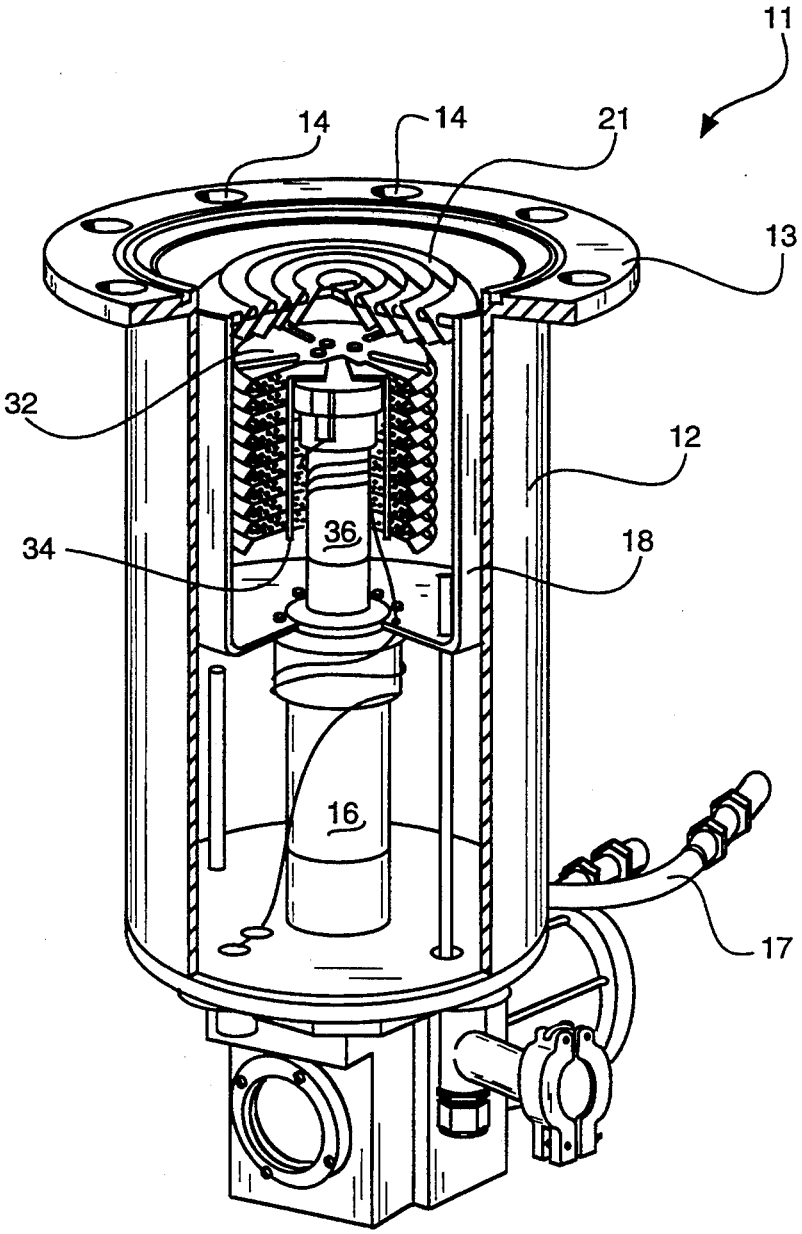
FIG. 1 is an isometric view of a two-stage cryogenic pump incorporating the instant invention.

The following relatively detailed description is provided to satisfy the patent statutes. However, it will be appreciated by those skilled in the art that various changes and modifications can be made without departing from the invention. The following description is exemplary, rather than exhaustive.

A two-stage cryogenic pump incorporating the invention is generally referred to with the reference numeral 11. Such pump includes an outer vacuum vessel 12 having a cylindrical opening at one end circumscribed by a mounting flange 13. Flange 13 includes typical bores 14 for securance of the same in accordance with standard practice via a gate valve or the like to a vacuum chamber to be pumped.

Vessel 12 houses a conventional refrigeration cylinder 16 axially within the same. Such cylinder supports and provides the desired low temperatures to the first and second stages of the pump. In this connection, in accordance with conventional practice the cylinder 16 relies on the condensation of helium to obtain the low temperatures. A compressor (not shown) supplies room temperature helium under pressure to the pump via connection 17, which helium is allowed to expand to provide cooling for the two stages of the pump.

The first or, in other words, initial stage of the pump is made up of a radiation shield 18 which supports an array 21 of coaxial annular fins. The array 21 provides the dual function of acting not only to provide an extended surface area for condensation at the initial stage, but also to protect the lower temperature condensation and adsorbent second stage from direct line-of-sight exposure to the gases to be pumped. With respect to the latter, such array is constructed to provide overlapping surface areas which block such line-of-sight but yet permit passage therethrough of those gases which do not condense on the same. It is thermally coupled via the radiation shield 18 to the central area of the cylinder 16 so as to be maintained at a temperature within the range of 50°–80° K. A washer 22 made of a good thermally conductive material, such as indium, is provided at the physical connection of the shield to the cylinder 16 to assure good thermal conduction between the two. The array 21 acts, in essence, as means positioned in the path of the flow of gases to be pumped for condensing particular ones of the gases.

The second stage of the pump includes an array, in this case eight, of condensing panels 23. The purpose of the condensing panels is not only to provide second stage condensing for those gases which will condense at a lower temperature, e.g., within the range of 10°–22° K., but also to provide substrates for a coating of an adsorbent material. That is, the exterior underneath surface of each of the panels 23 is coated with a multitude of pieces of an adsorbent material.

Figure 2:
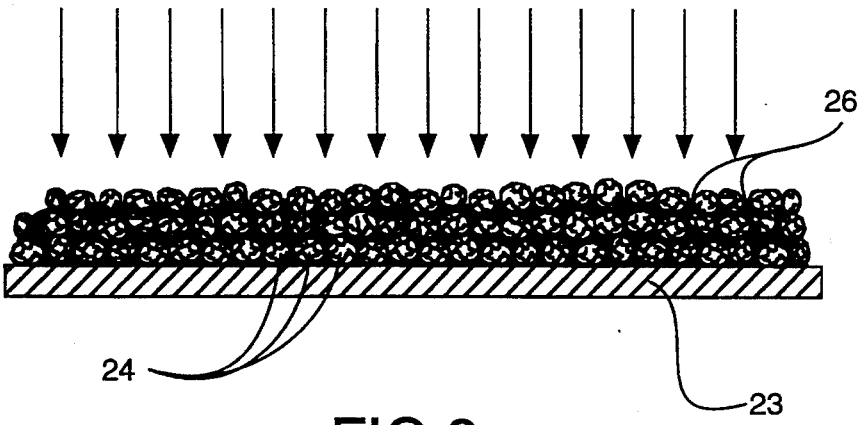
FIG. 2 is an enlarged schematic view illustrating in section, the construction of the 3-dimensional adsorbent structure of the instant invention.

In keeping with the invention, the surface coating includes a multitude of pieces 24 of an adsorbent material which are adhered thereto on top of one another by an adhesive 26 as is illustrated in FIG. 2. The adhesive is selected to be transparent to the passage of the gases to be pumped by adsorption. The coating includes a sufficient number of pieces of the adsorbent material so that pieces of the same are completely encompassed by the transparent adhesive. The interior pieces of the adsorbent material are completely encompassed by the adhesive and the interstices between adjacent pieces are filled with the transparent adhesive. This is to be contrasted with prior art arrangements in which care is taken to assure that significant surface area of each of the pieces of adsorbent material remains exposed for adsorption.

A 3-dimensional adsorbent structure is provided by the invention. The construction can be thought of as a multi-layer adsorbent material construction, as opposed to the single layer construction which is conventional. A suitable mixture of both adsorbent pieces and a transparent adhesive is that sold by American Norrit Company, Inc., having a place of business at 1050 Crown Point Parkway, Suite 500, Atlanta, Ga., with the designation Norithene Plates. The pieces of adsorbent material in this mixture are pieces of activated charcoal. It will be recognized by those skilled in the field that pieces of other materials, such as artificial zeolite, which are adsorbent to the gases to be pumped can be used. The adhesive is an organic polymer resin. It also will be recognized by those skilled in the art that other adhesives can be selected which meet the criteria of being transparent to the gases to be adsorbed.

As a major feature of the invention, the 3-dimensional structure of the invention confronts molecules of gases which may be adsorbed with a 3-dimensional adsorbing structure having a relatively significant thickness in the direction of gas flow. Those molecules having generally too much energy at the time of first contact with the adsorbent structure to be adsorbed, will pass through the surface into the interior of the adsorbent structure. Insofar as the theory of operation is concerned, it is believed these molecules will be slowed down by the structure and then captured by adsorption when they have an appropriate energy state by contacting an adsorbent surface within the interior of the structure.

Most desirably, the adsorbent characteristics of the 3-dimensional structure are enhanced by maintaining a temperature gradient within the structure in the direction of gas flow therethrough, i.e., between the panel 23 and the exposed surface of the coating which is spaced away from such panel by the thickness of such coating. It has been found that the thickness of the adsorbent structure should be selected so that the temperature of the exposed surface of the material most desirably is at least 1° K. higher than that of the underlying panel. It is conjectured that this temperature differential aids in the adsorbent process by providing a reverse temperature differential for the adsorbent material throughout the structure, thereby cooperating with the mobility loss aspects of the 3-dimensional structure discussed above, to assure adsorbency.

The thickness of the coating will depend upon many factors, including the particular material that is used for adsorbency, the number of particles, the transparent adhesive, etc. The thickness is best defined from the standpoint of this invention in terms of the temperature. It is desirable that the adsorbent structure have sufficient thickness to provide the surface spaced away from the panel with a temperature as discussed above which is at least 1° K. higher than the panel itself.

Figure 3:
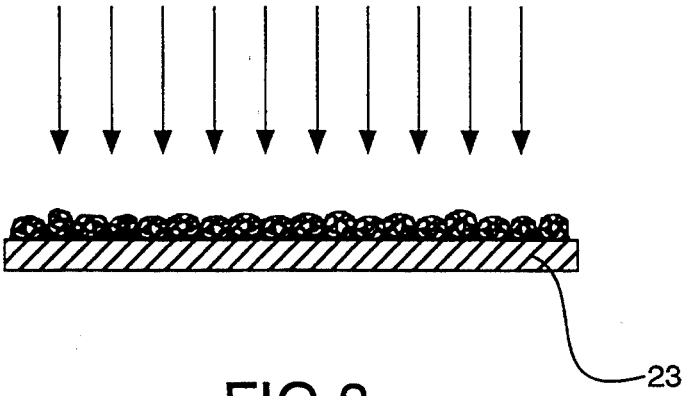
FIG.3 (PRIOR ART)
FIG. 3 is an enlarged sectional view similar to FIG. 2 of a typical prior art arrangement.

The construction of the invention is schematically illustrated in FIG. 2. In the past it has been the practice as shown in FIG. 3 to strive to maintain the adsorbent material in a single layer of pieces on the panel 23 and to reduce to the extent practical the adhesive which is used to maintain the pieces on such panel. The adhesives used in the past, typically an epoxy, have passivated the adsorbing surfaces provided by the pieces of material, thereby reducing the adsorbency.

Figure 4:
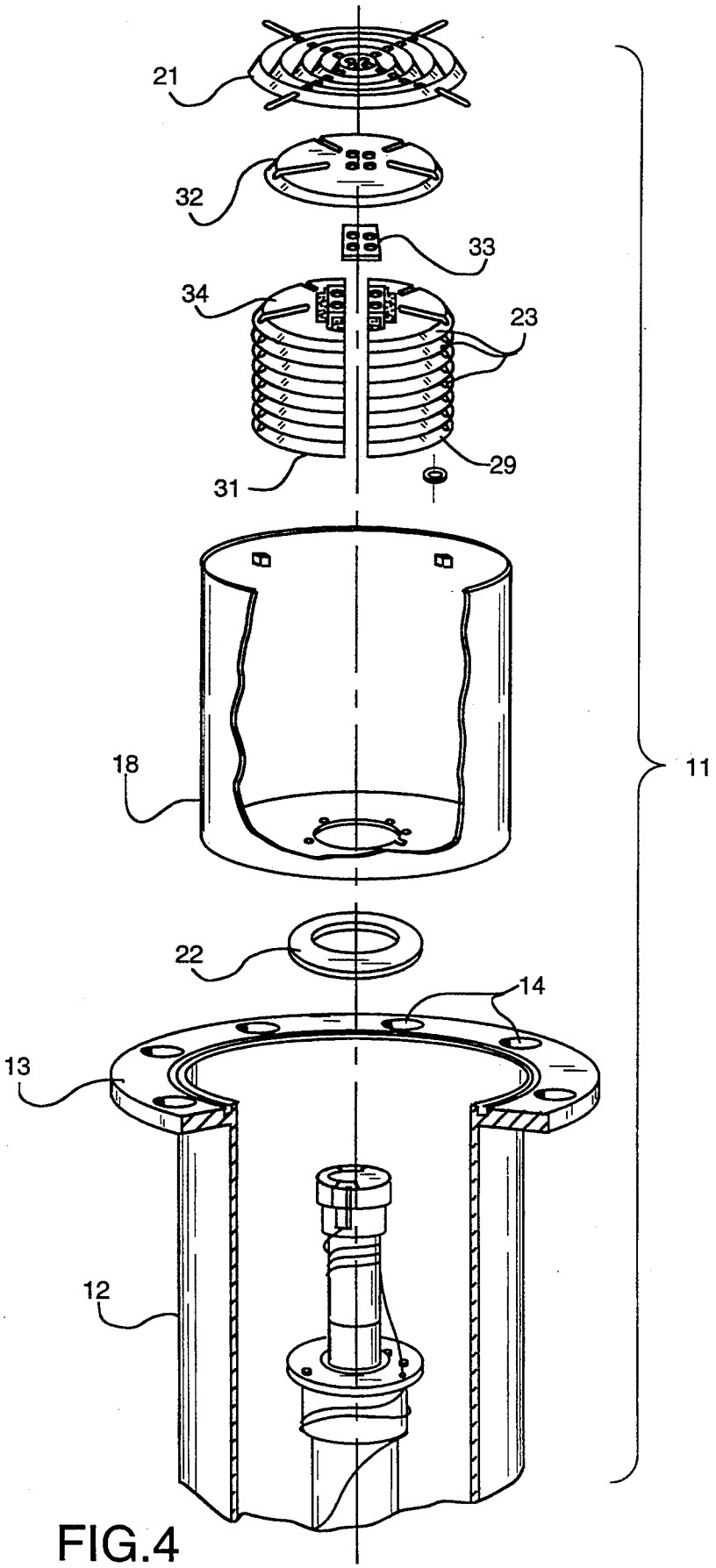
FIG. 4 is an exploded view of the preferred embodiment illustrated in FIG. 1.

Each of the panels 23 is, in fact, provided by two separate panel halves 29 and 31 as is illustrated in FIG. 4. A top plate 32 for the panel array is also provided with a indium plate connector 33 providing good thermal conductivity between such plate and the remainder of the array. An L-bracket construction illustrated at 34 is used to maintain the entire construction within the interior of the pump securely adhered in thermal conductive relationship to the upper end 36 of the refrigeration cylinder 16. Thus, such cylinder provides the desired lower temperature for the second stage of the pump. It can be thought of as means for cooling the panels of the invention as well as for cooling the array 21 of the first stage. Moreover, it is responsible for providing the temperature gradient through the 3-dimensional adsorbent structure.

It is to be noted that except for the invention aspects, the pump is a Cryo-Torr® pump available from CTI Cryogenics, a Division of Helix Technology Corporation, having a place of business at 266 Second Avenue, Waltham, Mass. Its use with the invention emphasizes the retrofittable nature of the invention.

As mentioned at the beginning of the detailed description, applicant is not limited to the specific embodiment described above. Various changes and modifications can be made. The claims, their equivalents and their equivalent language define the scope of protection.

What is claimed is:

1. A cryopump comprising the combination of:

(a) means positioned in the path of a flow of gases to be pumped for condensing particular ones of said gases;

(b) a thermally conductive panel substrate having a coating providing a pair of surfaces, one of which is in thermal contact with said panel and the other of which is to be exposed to non-condensible gases to be adsorbed, the structure of said coating including a multitude of pieces of activated charcoal adhered on top of one another by an adhesive which is transparent to the passage of said non-condensible gases to be pumped by adsorption, said thermally conductive panel and said coating forming a pumping structure, some of said pieces having adsorbing surface area completely covered by said adhesive and positioned to adsorb non-condensible gases which pass through said adhesive; and (c) a cooler for said panel.

2. The pump of claim 1 wherein the thickness of said structure is selected to provide a temperature gradient of at least 1° K. from the panel to said other surface of said coating which is spaced away by the thickness of said coating from said panel.

3. The pump of claim 1 wherein said adhesive is an organic polymer resin.

4. In apparatus for adsorbent pumping of gases in which a multitude of pieces of an activated charcoal is adhered to a thermally conductive substrate, the combination of an adhesive which is transparent to passage of non-condensible gases to be pumped by adsorption and a plurality of said pieces adhered on top of one another by said adhesive to form an adsorbent structure with some of said pieces having adsorbing surface area completely covered by said adhesive and positioned to adsorb non-condensible gases which pass through said adhesive.

5. The apparatus of claim 4 wherein interstices between said adjacent pieces are filled with said transparent adhesive.

6. The apparatus of claim 4 further including as part of said combination means for providing a temperature gradient of at least 10 K in said adsorbent structure in the direction of intended gas flow therethrough.

7. The apparatus of claim 4 wherein said adhesive is an organic polymer resin.

8. In a method of making a cryogenic pumping surface, the step of:

coating an adsorbent surface of a thermally conductive substrate with both an adhesive transparent to passage of non-condensible gases to be pumped by adsorption and a multitude of pieces of activated charcoal on top of one another with adsorbing surface area of some of said pieces covered completely by said adhesive and positioned on said substrate to adsorb non-condensible gases which pass through said adhesive.

9. The method of claim 8 wherein said step of coating includes providing that number of pieces of said activated charcoal on said substrate needed to form a 3-dimensional adsorbent structure having pieces of said activated charcoal completely encompassed by said adhesive.

10. The method of claim 8 wherein said step of coating includes providing that number of pieces of said activated charcoal on said substrate needed to form a temperature gradient in said structure in the direction of flow of non-condensible gases through said activated charcoal.

11. An adsorbent panel for a cryopump having means positioned in the path of the flow of gases to be pumped for condensing particular ones of said gases, comprising:

(A) a thermally conductive substrate having a surface to be exposed to gases to be adsorbed;

(B) a coating of a multitude of pieces of activated charcoal adhered on said surface on top of one another by an adhesive which is transparent to the passage of non-condensible gases to be pumped by adsorption with adsorbing surface area of some of said pieces covered completely by said adhesive and positioned on said substrate to adsorb molecules of non-condensible gases which pass through said adhesive.

12. The panel of claim 11 wherein the thickness of said coating on said substrate is selected to provide a temperature gradient from said substrate to that surface of said coating spaced away by the thickness of said coating from said substrate.

13. The panel of claim 11 wherein interstices between said adjacent pieces are filled with said transparent adhesive.

14. The panel of claim 11 wherein the thickness of said coating is selected to maintain its exposed surface at a temperature which is at least 1° K. higher than that of said substrate.

15. The panel of claim 11 wherein said adhesive is an organic polymer resin.

16. An adsorbent panel for a cryopump having means positioned in the path of the flow of gases to be pumped for condensing particular ones of said gases, comprising:

(a) a thermally conductive substrate having a surface to be exposed to gases to be adsorbed;

(b) a coating of a multitude of pieces of a adsorbent material adhered on said surface on top of one another by an adhesive which is transparent to the passage of non-condensible gases to be pumped by adsorption, with adsorbing surface area of some of said pieces covered completely by said adhesive and positioned on said substrate to adsorb molecules of non-adsorbent gases which pass through said adhesive, the thickness of said coating on said substrate being selected to provide a temperature gradient of at least 1° K. from said substrate to that surface of said coating spaced away by the thickness of said coating from said substrate.

17. The panel of claim 16 wherein interstices between adjacent one of said pieces are filled with said transparent adhesive.

18. The panel of claim 16 wherein said adhesive is an organic polymer resin.

* * * * *